United States Patent [19]

Garber

[11] Patent Number: 4,592,552

[45] Date of Patent: Jun. 3, 1986

[54] GOLF CLUB PUTTER

[76] Inventor: Robert L. Garber, 409 N. Menard, Box 445, Metamora, Ill. 61548

[21] Appl. No.: 696,401

[22] Filed: Jan. 30, 1985

[51] Int. Cl.[4] ..... A63B 53/04

[52] U.S. Cl. ..... 273/168; 273/80 C; 273/77 R; 273/167 H

[58] Field of Search ..... 273/168, 77 B, 167 D, 273/167 F, 167 G, 80 C, 167 H, 169

[56] References Cited

U.S. PATENT DOCUMENTS 2,336,405 12/1943 Kent ..... 273/168 X 2,843,384 7/1958 Schmidt ..... 273/77 B

*Primary Examiner*—George J. Marlo

*Attorney, Agent, or Firm*—Stephen L. Noe

[57] ABSTRACT

A golf club putter (10) is provided that includes a head (12) having first and second putting faces (18, 20) positioned perpendicular to one another and at identical predetermined angles to a top surface (14). The head (12) includes an offset hosel (44) extending generally upwardly from the top surface (14). The hosel (44) has a first end portion (46) connected to the head top surface (14) along an edge opposite the first and second putting faces (18, 20), a second end portion (48) projecting upwardly from the top surface (14) along an axis parallel to and proximate one of the first and second putting faces (18, 20) and at a predetermined angle to the other of the first and second putting faces (18, 20), and an intermediate transverse connecting portion (52) extending across the top surface (14). A shaft (54) has a first end portion (56) connected to the hosel second end portion (48) and extends upwardly therefrom. The particular construction of the head (12), hosel (44) and shaft (54), advantageously forms a putter (10) that is convenient to use both in a conventional side swing manner, and also croquet style. Thus, one putter serves both for long putts where distance is the overriding concern, and for short putts where it is important to maintain a line-of-sight from the ball to the cup.

3 Claims, 4 Drawing Figures

GOLF CLUB PUTTER

TECHNICAL FIELD

This invention relates generally to a club type instrument for striking a ball and, more particularly, to a golf club for putting a golf ball.

BACKGROUND ART

Golf clubs of various types and designs are readily available on the market today. A number of the available golf clubs are specially designed for use in putting a golf ball along a substantially smooth grass portion of a golf course. Owing to the fact that putting often accounts for nearly half of a golfer's total strokes over an average course, such specialized clubs are of particular importance to dedicated golfers.

While a substantial number of golf club putters (putters hereinafter) are available, they typically embrace modifies forms of a design common to non-putter type golf clubs, i.e., they are intended to be swung in an arc substantially across and inclined to the front of the golfer's body. This conventional style of swing imparts a great deal of energy to the ball, owing to the distance the golf club head travels along the arc of the swing, and is advantageous when it is desired to drive the ball a great distance through the air.

In order to accomplish the conventional golf swing, the golfer stands facing the ball, with the cup located at an approximate 90 degree angle from the direction in which the golfer is facing. Taking this stance, the golfer must choose between looking at the ball, the terrain over which the ball is intended to travel, or the cup. In no manner can the golfer obtain a line-of-sight that includes both the ball and the cup while occupied with this stance. Nevertheless, this stance and approach is advantageous when attempting very long putts owing to the large amount of energy imparted to the ball. However, the vast majority of putts attempted are of relatively short distance, and require accuracy rather than brute force. For this majority of putts, the conventional stance offers serious difficulties, and the long backstroke and follow through provided are of no particular benefit.

As mentioned above, the golfer cannot establish a line-of-sight from the ball to the cup while facing 90 degrees from the cup. When using the conventional stance, most golfers stand behind the ball to establish such a line-of-sight, then loose the effect upon approaching the ball. It has been found advantageous in many other sports to continuously maintain such a direct line-of-sight. For example, it is generally conceded that the jump shot has greatly contributed to modern basketball field-goal percentages. The jump shot is especially effective because the shooter jumps directly toward the basket when he releases the ball. His hand and arm, the ball, and the basket are all along a line or arc extending directly in front of the shooter. This is in contrast to the low percentage hook shot attempted at approximately a 90 degree angle from the front of the shooter's body. Likewise, in baseball, fielders are instructed to position themselves directly in front of a ground ball, allowing them to follow the ball straight into the glove, and greatly reducing the chance of error. Similar logic is believed applicable to putting, where the chance of error can be greatly reduced, and the percentage of completed putts increased, by keeping the ball in front of the golfer along a line-of-sight to the cup.

Croquet style putters have been proposed in the past, which partially recognize the advantage of maintaining such a line-of-sight. However, these clubs also exhibit significant disadvantages. For example, the United States Golf Association rules require that a golfer have both feet on one side of a line extending from the ball to the cup. This rule effectively prohibits swinging a croquet style putter between the legs. Also, the existing croquet style putters are not configured for use with a conventional swing, and so are limited to use in short distance putting. Since a golfer is likely to encounter situations requiring both long and short putts during the course of a game, such putters constitute an additional club to be carried along with a conventional putter.

The present invention is directed to overcoming one or more of the problems as set forth above.

DISCLOSURE OF THE INVENTION

In one aspect of the present invention, a golf club for putting is provided. The club includes a head having a top surface lying in a substantially horizontal top plane, and first and second striking surfaces connected to and extending downwardly from the top surface. The striking surfaces lie in respective first and second planes which are substantially perpendicular to one another and to the top plane.

The present invention facilitates putting corquet style, standing behind the ball and directly facing both the ball and the cup, while complying with established golf association rules. In addition, the present invention also permits putting in a conventional manner, facing the ball while standing at substantially a 90 degree angle to the cup, where the lie of the ball dictates such an approach.

BRIEF DESCRIPTION OF THE DRAWINGS

For a better understanding of the present invention, reference may be made to the accompanying drawings, in which.

BEST MODE FOR CARRYING OUT THE INVENTION

Figure 1:
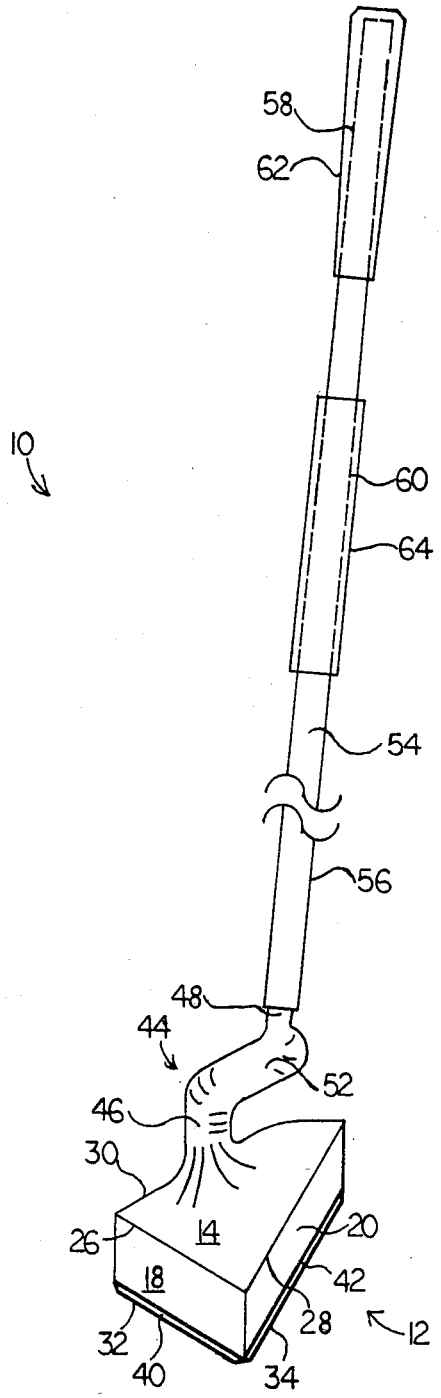
FIG. 1 is a pictorial view of a golf club incorporating an embodiment of the present invention; and, FIGS. 2A, 2B, and 2C are respective front, right side, and left side elevation views of a golf club head used in the embodiment of FIG. 1.

Referring first to FIG. 1, a golf club putter embodying the principles of the present invention is generally indicated by the reference numeral 10. The club includes a head 12 and a shaft 54, connected one to the other by a hosel 44.

Figures 2A, 2B, 2C:
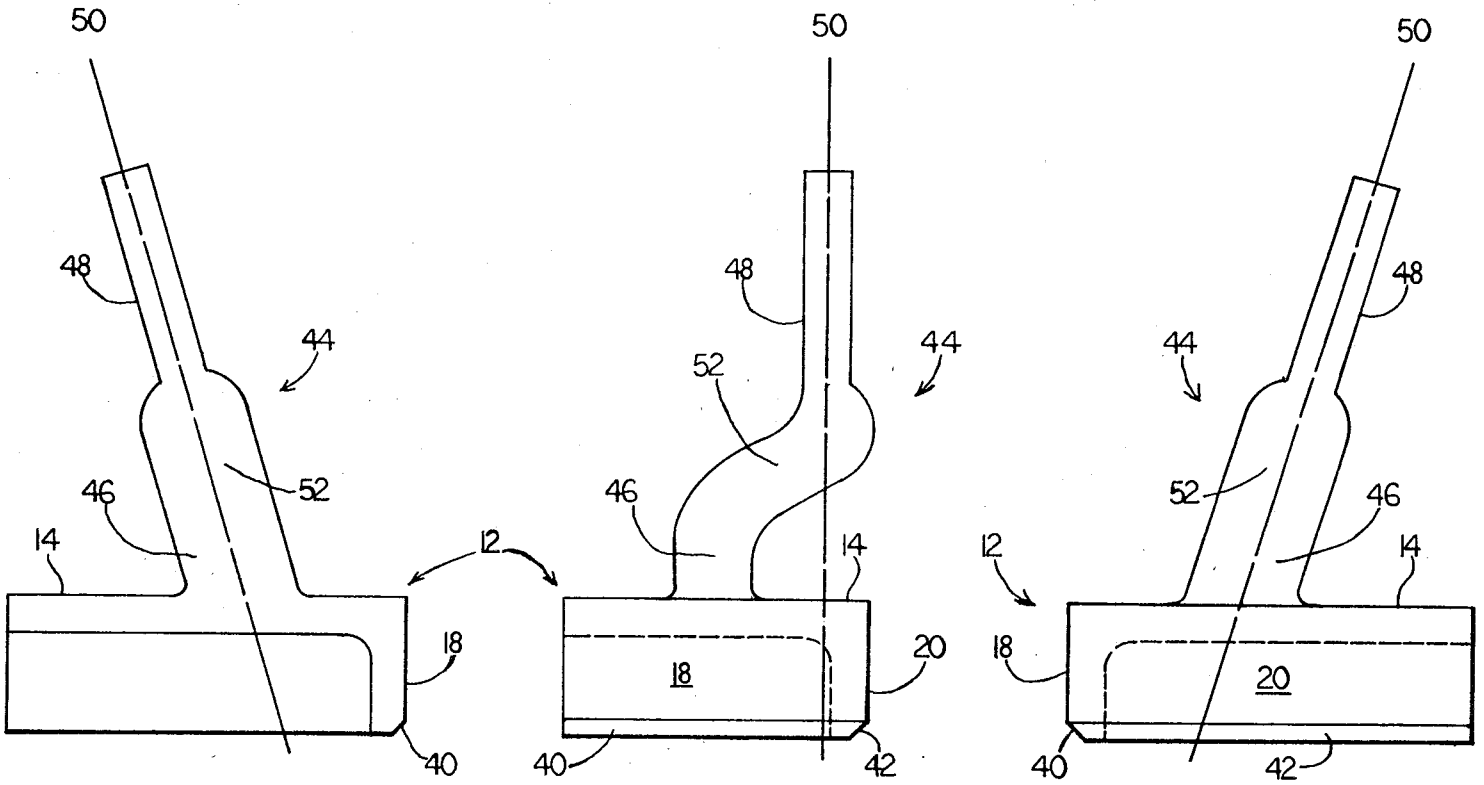

While the following discussion refers specifically to FIG. 1, details of construction can best be seen by occasional reference to FIGS. 2A, 2B, and 2C. The head 12 includes first and second striking surfaces 18,20 located along respective first and second planes. The first and second striking surfaces 18,20 are substantially perpendicular to one another. The head 12 also includes a top surface 14 located along a top plane, substantially perpendicular to each of the first and second striking surfaces 18,20.

The top surface 14 substantially forms a right triangle having first and second adjacent edges 26,28 connected to one another to form an approximate right angle, and a third edge 30 connected to the first and second adjacent edges 26,28 at respective acute angles. The third edge 30 substantially forms the hypotenuse of the right triangle.

The first and second striking surfaces 18,20 extend downwardly from the respective first and second adjacent edges 26,28, and each of the first and second striking surfaces 18,20 includes a respective bottom edge 32,34. The third edge 30 is free from having a downwardly extending striking surface. The first and second bottom edges 32,34 lie in a bottom plane spaced apart from and substantially parallel to the top plane. The top and bottom planes, in cooperation with the first and second striking surface planes, define a cavity. Each of the first and second bottom edges 32,34 includes a respective outwardly facing chamber 40,42 along the intersection of the bottom plane and the respective first and second striking surface plane.

The hosel 44 includes a first end portion 46 connected to the head top surface 14, and a second end portion 48 extending upwardly from the top surface 14. "Hosel" herein is used to designate the entire portion of the club head 12 extending from the top surface 14 to the shaft 54. The hosel first end portion 46 is preferably connected to the top surface 14 at a location spaced apart and substantially equidistant from the first and second striking surfaces 18,20, and substantially mediate the third edge 30. The hose second end portion 48 projects upwardly from the top surface 14 along an axis 50 substantially parallel to one of the first and second striking surface planes, and at an acute angle to the other of the first and second striking surface planes. The acute angle is preferably less than sixteen degrees, and is required to be greater than ten degrees by the United States Golf Association rules. The hosel 44 also includes an intermediate portion 52 connected to each of the hosel first and second end portions 46,48. The hosel intermediate portion 52 preferably slopes toward one of the first and second striking surfaces 18,20.

The shaft 54 includes first and second end portions 56,58, and an intermediate portion 60. The shaft first end portion 56 is connected to the hosel second end portion 48, in a conventional manner. Each of the shaft second end and intermediate portions 58,60 are at least partially covered by respective individual gripping portions 62,64.

USE OF THE INVENTION

The instant invention is particularly adapted for use in both long and short putting situations. Where a relatively long putt is being attempted, for example, in excess of 45 feet, a conventional golf stance is assumed. The golfer stands facing the ball, with the cup located approximately 90 degrees from the direction in which the golfer is facing.

The club 10 is gripped with both hands on the shaft second gripping portion 62. The club 10 is rotated such that the second striking surface 20 is positioned to address the ball, and the golfer positions himself a sufficient distance from the ball to cause the top surface 14 of the club 10 to lie in a plane substantially parallel to the surface of the ground. Owing to the small angle between the axis of the shaft 54 and the first striking surface 18, and the consequentially small angle between the shaft 54 and a line perpendicular to the surface of the ground, the golfer is positioned relatively close to the ball as compared to golf clubs designed to propel the ball great distances. The relatively close position of the golfer's body to the ball aids in achieving a tightly controlled swing. The chamfers 40,42 along the striking surface bottom edges 32,34 prevent the head 12 from catching on the grass of the putting surface.

In the more common putting situation involving a relatively short distance, for example, less than 45 feet, the golfer assumes a totally different stance, substantially behind and slightly to one side of a line extending from the ball to the cup. The club 10 is rotated 90 degrees from the above described position, such that the first striking surface 18 is positioned to address the ball. The club 10 is preferably gripped with the left hand positioned on the second gripping portion 62 and the right hand positioned on the intermediate gripping portion 64. It has been found that some golfers prefer a backhand or reverse grip to that just described. In either event, the golfer is now positioned to accurately stroke the club 10 back beside his foot along a line extending substantially directly from the ball to the cup, and coinciding with his line-of-sight. Little force is required for such short putts, and the inertia of the head is sufficient to propel the ball to the cup, without need for a long back stroke. The offset position of the head 12 relative to the shaft 54, caused by the slope of the hosel intermediate portion 52, advantageously aids the golfer in keeping the club 10 close to his body while putting, and further enhance this style of putting.

The above description, and the appended Figures, refer specifically to a club 10 manufactured for use by a right handed golfer. This assumption is made purely for convenience sake, and it would be obvious to one skilled in the art to produce a mirror image club designed for use by left handed golfers. Such reversal of design, and other minor modifications to the described invention, is specifically intended to be embraced by the appended claims. Also, although the term line-of-sight is used throughout with reference to a line extending from the ball to the cup, it will be appreciated that such a line is often found to extend, in fact, from the ball to a predetermined point other than the cup, in order to account for variations in the terrain intermediate the ball and the cup.

Other aspect, objects, advantages and uses of the instant invention can be obtained from a study of the drawings, the disclosure and the appended claims.

I claim:

1. A golf club for putting, comprising:

a head having a top surface and first and second putting faces, said top surface having first and second adjacent edges joined at a right angle and a third edge positioned opposite said right angle, said first and second putting faces extending downwardly from respective ones of said first and second adjacent edges at identical angles relative to said top surface;

a hosel extending generally upwardly from said top surface, said hosel having a first end portion connected to said top surface along said third edge of said top surface, a second end portion extending upwardly from said top surface along an axis parallel to and proximate one of said first and second putting faces and at a predetermined angle to the other of said first and second putting faces, and an intermediate portion extending transversely across said top surface toward one of said first and second adjacent edges and connecting said first and second hosel end portions; and a shaft having a first end portion connected to said hosel second end portion, said shaft extending upwardly therefrom.

2. A golf club for putting, as set forth in claim 1, wherein said first and second putting faces each extend perpendicularly downwardly from said top surface.

3. A golf club for putting, as set forth in claim 1, wherein said hosel first end portion is connected to said top surface at a generally mediate location along said third edge of said top surface.

* * * * *